US006623535B1

(12) United States Patent
Kief

(10) Patent No.: US 6,623,535 B1
(45) Date of Patent: Sep. 23, 2003

(54) FUEL ADDITIVE FOR REDUCTION OF POLLUTANT EMISSIONS

(76) Inventor: Horst Kief, Londoner Ring 105, D-67069, Ludwigshafen (DE)

( * ) Notice: Subject to any disclaimer, the term of this patent is extended or adjusted under 35 U.S.C. 154(b) by 0 days.

(21) Appl. No.: 09/634,897

(22) Filed: Aug. 9, 2000

Related U.S. Application Data

(63) Continuation-in-part of application No. 09/346,820, filed on Jul. 2, 1999, now abandoned.

(51) Int. Cl.[7] ..... C10L 1/18
(52) U.S. Cl. ..... 44/301; 44/302; 44/437
(58) Field of Search ..... 44/437, 444, 301, 44/302

(56) References Cited

U.S. PATENT DOCUMENTS 4,541,837 A * 9/1985 Norton et al. ..... 44/437
6,013,114 A * 1/2000 Hille et al. ..... 44/308

* cited by examiner

*Primary Examiner*—Cephia D. Toomer
(74) *Attorney, Agent, or Firm*—Charles D. Gunter, Jr.

(57) ABSTRACT

Glyoxal in an aqueous solution is used in a fuel additive in order to reduce pollutants in the exhaust gases of gasoline and diesel engines. It is sufficient to add glyoxal in aqueous solution to gasoline in the dilution in the ratio of 1:10 000 and higher in order to obtain a reduction of unburned hydrocarbons and carbon monoxide in vehicles with catalytic converters at idle and at increased idle of almost 100%. Esterified aliphats and polyethyleneglycol are added as emulsifiers and solubilizers. Additionally, glyoxal can be used in form of its acetals and hemiacetals with the resultant product being added to the fuel in combustion engines in order to reduce the pollutant emission and carbon particles/deposits.

17 Claims, 3 Drawing Sheets

FUEL ADDITIVE FOR REDUCTION OF POLLUTANT EMISSIONS

CROSS REFERENCE TO RELATED APPLICATIONS

This application in part discloses and claims subject matter disclosed in the earlier filed pending continuation in part application, Ser. No. 09/346,820, filed Jul. 2, 1999, now abandoned.

BACKGROUND OF THE INVENTION

1. Field of the Invention

The present invention relates to fuel additives for internal combustion engine fuels, particularly for gasoline and diesel engine fuels, which provide a reduction in pollutant emissions and coke deposits, improved efficiency, smoother running of the engine as well as a cleaning effect on the combustion chamber of the engine.

2. Description of the Prior Art

Fuels for the internal combustion engines and turbines damage the environment due to, among other factors, the incomplete combustion in the engines, of hydrocarbons, carbon monoxides and nitrogen oxides. Metal-ceramic catalytic converters are known to reduce this damage by means of catalytic afterburning of the engine exhausts. The combustion energy released thereby cannot be used, however, for the primary process of energy production in the engine. Also, the efficiency of the catalytic converter can decrease over time leading to increased pollutant emission levels. The addition of a fuel additive, prior to the combustion stage, would have distinct advantages over, or in addition to the traditional methods for handling exhaust emissions.

The amelioration of fuel qualities by the addition of diverse substances is a familiar technique in the prior art. Thus, e.g., according to DE-PS 582 718, heavy metal salts, namely, cooper, nickel, cobalt, zinc and chromium salts, as well as the condensation products of amines with compounds which contain one or more oxygen groups in addition to a carbonyl group, are added to the fuel in order to improve its knock resistance. In DE-PS 448 620 and DE-PS 455 525, fuels are described which have a content of iron carbonyl or nickel, cobalt and/or molybdenum carbonyl. However, these techniques have not become popular, because the use of metal carbonyls causes a metal oxide deposit in the combustion chamber of the vehicle and are toxic. DE-PS 801 865 teaches the use of fuel additives, which can be toluene, benzene, acetone trichlorethylene or isobutyl alcohol, besides the metal carbonyls, although the fundamental drawback of metal oxide deposits in the combustion chamber remains the same. DE-AS 1 221 488 describes fuel additives consisting of methylcyclopentadienyl manganese tricarbonyl, lead tetraethyl or other organometallic compounds and organic compounds having two ester groups. The following organic fuel additives are also recognized as constituting a part of the state-of-the-art: a mixture of an aromatic amine and a polyalkyl phenol, as shown in DE-PS 845 286; tretaarylhydrazine, diarylnitrosamine and triarylmethyl derivatives from DE-PS 505 928; aldehydes, quinones and ketones from DE-PS 612 073; ketones of formula R—CO—R', wherein R represents a ring radical and R' an aliphatic radical with at least 6 C-atoms, from U.S. Pat. No. 2,100,287; hydroquinone in a benzene solution from DE-PS 486 609; ether derivatives from DE-PS 703 030; alcohols from DE-PS 843 328; condensation products of alkylene oxides and alkylphenols from DE-PS 19 37 000; anthracene derivatives from U.S. Pat. No. 1,885,190 and 1.4-dialkyl-arylamino-anthraquinone from EP 09 095 975 B1.

U.S. Pat. No. 1,973,475 describes a method for oxidation of fuels with air or oxygen at elevated temperatures, possible in the presence of a catalyst. DE-PS 699 273 discloses a method of dehydrogenation of nonflammable oils from the boiling range of diesel oils in inflammable oils with oxidizing agents such as air or oxygen, ozone, peroxides, chromic acid or nitric acid at 150°–350° C., possibly at elevated pressure and preferably in presence of a catalyst. The ozonization of fuels is also described in DE-PS 324 294 and DE-PS 553 943. According to DE-PS 324 294, ozonides such as ethylene ozonide, or a mixture of one of the conventional fuels with an ozonide, are added to the internal combustion engine. The drawback of the method is the instability of the ozonides, so that when kept for a lengthy time the availability of oxygen carriers is necessarily variable, apart from the problems of environmental pollution, which were not known at the time. According to DE-PS 553 943, a mixture of hydrocarbons is ozonized under pressure in the presence of an oxygen carrier, such as turpentine oil, and slight amounts of ignition-promoting substances.

The procedures described in the patents above have not been commercialized. The described substances are partially toxic, carcinogenic or the procedures are too expensive. They do not add any value in the petrochemical market.

In DE 1144971 there is shown the use of tetraethyl lead in addition to monocarbonacids, to achieve boosting of the octane number. In DE 1271455 diketons are patented in combination with tetraethyl lead as antiknock-substances. The substance with the general formula R—(O—X)$_n$—O—R) patented in the U.S. Pat. No. 2,655,440 also has another structure which is the substance of the submitted present application. The use of glyoxal in DE 19527423A1, generated by ozonization of gasoline containing benzene has the disadvantage, that ozonization apparatus in a refinery is unusual and expensive.

SUMMARY OF THE INVENTION

The present invention has as its object to reduce the emission of pollutants and the consumption of fossil fuels and their derivatives. The pollution of environment by the incomplete combustion sequence in detonation engines with expulsion of carbon monoxide, unburned hydrocarbons, as well as nitrogen oxide is sufficiently well known. Subsequent use of catalytic converters, and the like, are a stop gap measure, at best. Thus, preference should be given to an optimization of the combustion process in the immediate energy-supplying step.

The present invention accomplishes this purpose in a fundamental, technically feasible and effective mode and manner.

In the present invention, pollutant emissions from combustion engines are reduced by the addition of glyoxal and glyoxal derivatives and adducts in aqueous solution to the fuel supply to the combustion engine. Preferably, different acetals and hemiacetals or a mixture thereof obtained by the acetalization of glyoxal are added to the fuel.

It is proposed to use glyoxal in an aqueous solution in order to reduce pollutants in the exhaust gases of gasoline and diesel engines. It is sufficient to add glyoxal in aqueous solution to gasoline in the dilution in the ratio of 1:10,000 and higher in order to obtain a reduction of unburnt hydrocarbons and carbon monoxides in vehicles with catalytic converters at idle and at increased idle of almost 100%. It is recommended to use esterified aliphats and polyethyleneglycol as emulsifiers and solubilizers. Furthermore, it is suggested to separate the glyoxal from its aqueous solution by binding the acetal and to add this component to the fuel in combustion engines as an emulsifier and homogen catalyzer in order to reduce the pollutant emission.

Additional objects, features and advantages will be apparent in the written description which follows.

DETAILED DESCRIPTION OF THE INVENTION

Figure 1:
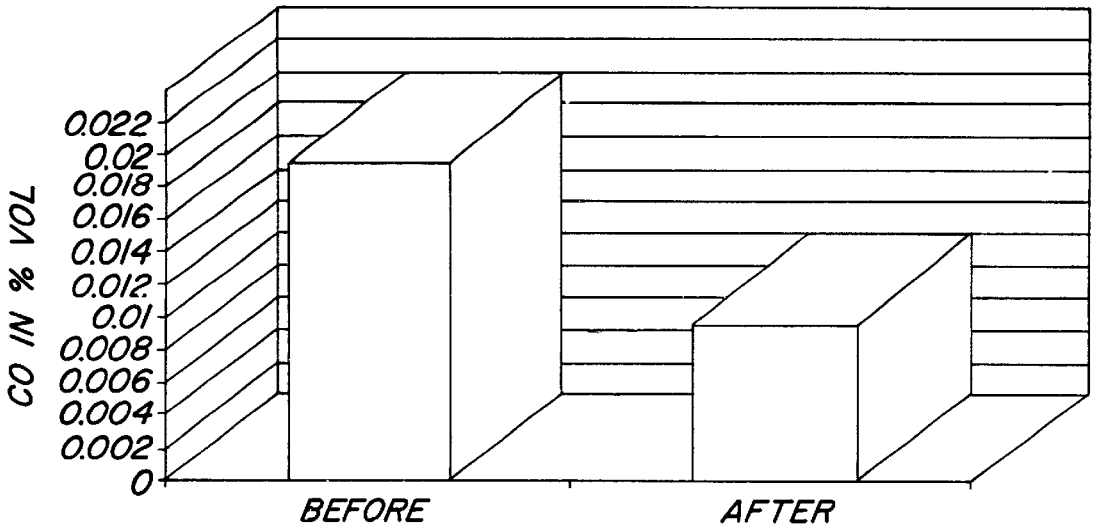
FIG. 1 is a graph of the reduction in emission of CO achieved through the use of the additives of the invention with the engine at idle.

Applicant's EP94/02052, now issued as U.S. Pat. No. 5,762,655, describes a technique for optimizing the combustion process in internal combustion engines. In that process, the ozonization products of gasoline and diesel fuels provide a catalytic effect on the combustion process with the result that unburned hydrocarbons and carbon monoxide are reduced drastically. On one hand, this technique has the advantage that it is highly effective. On the other hand, however, it has the disadvantage that it is relatively costly since an ozonization system has to be integrated into the respective refinery plants supplying the combustion fuel.

The present invention has as its object to provide the same benefits achieved with the previously described ozonization process, but without the attendant expense.

In the present invention, glyoxal in aqueous solution is used as a basic product for fuel additives in order to obtain a reduction of pollutant emission. Glyoxal is obtained by oxidation from glycol in aqueous solution in industrial scale techniques. Here, glyoxal can be added to the fuel either together with flammable emulsifiers or in a chemical compound as described below. Compared to previous suggestions, this technique has the advantage that, here, a product can be used which is produced on an industrial scale and, therefore, economically and easily available; furthermore, the substances described herein are relatively stable in storage compared to the oxides which arose in the ozonization process of previous techniques and which drastically reduced the storage stability.

One method for reducing pollutant emission in internal combustion engines includes the steps of forming a fuel additive comprising an acetal and/or hemiacetal of glyoxal, with the glyoxal being bound by acetalization with alcohols and/or diols and/or triols in an aqueous phase. Separating the resulting product from its aqueous phase and thereafter adding the product to the fuel being supplied to the internal combustion engine. Then, burning the fuel in an internal combustion engine, whereby a reduced level of pollutant emissions results. The acetalization of the glyoxal may be achieved by reacting the glyoxal with a reactant selected from the group consisting of linear and branched alcohols from $C_1$ to $C_{16}$ and/or linear and/or branched diols and/or triols from $C_1$ to $C_{16}$. The acetalization agent, used in the acetalization of glyoxal, may be selected from the group consisting of methanol, ethanol, isopropanol, tertiary butanol, 1,3 propandiol, neopentylglycol and glycerol. Also, a mixture of different acetals and hemiacetals obtained by acetalization of glyoxal may be added to the fuel. The acetals and/or hemiacetals may comprise $C_1$ to $C_{16}$-alkoxy groups. The acetals and/orhemiacetals preferential are obtained by acetalization of glyoxal with linear and/or branched mono-, di- and trialcohols and have $C_1$ to $C_{16}$ carbons. The mono-, di- and trialcohols may be preferential selected from the group consisting of methanol, ethanol, isopropanol, tertier butanol, 1,3-propandiol, neopentyglycol and glycerol."

One factor to be considered in the practice of the present invention is the relative solubility of glyoxal in water when it is added to gasoline. It has been discovered, however, that a usual 40% glyoxal solution, together with a usual emulsifier consisting of esterified aliphatic compounds, can be mixed surprisingly well with gasoline if polyethyleneglycol is added. In the discussion which follows, "esterfied aliphatic compounds" will be taken to mean compounds of oleic acids and alcohols, the most well known being rape seed oil ester (with methanol). The Ecocool ACC product referred to below contains approximately 83% oleic acid condensation products (Xn R 36/38) and 17% alcanolamine (Xn R 20-36/37/38). The term "tensids" in the discussion which follows will be taken to mean esterfied aliphatic compounds made up of long chain alcohols and sulfuric acid. Tensids are surface active agents, surfactants, and can be ionic, cationic or non-ionic.

Thus, for example, 10 milliliters of a 40% glyoxal solution plus 10 milliliters of a standard, off the shelf emulsifier based on esterified aliphats (i.e. "Ecocool-ACC of the firm Fuchs Öle), as well as 10 milliliters polyethyleneglycol can easily be mixed with 500 milliliters gasoline. The emulsifier may be selected from the group consisting of methanol, ethanol, glycerol, glycol and mixtures thereof. The addition of the emulsifier serves to enhance the solubility of the aqueous solution of glyoxal in the fuel being burned.

The ratio of glyoxal solution, esterified aliphats and/or polyethyleneglycol maybe essentially 2:1:1 in the fuel additive. In addition, the ratio of the fuel additive to fuel may be between 1:500 and 1:2000. Also, phospholipids maybe used as emulsifiers to enhance the solubilityofaqueousglyoxal solution in the gasoline or diesel fuel. A mixture of glyoxal and/or of different acetals and/or hemiacetals may be obtained by acetalization of glyoxal and then added to the fuel. The phospholipids maybe added in the ratio of phospholipids to aqueous glyoxal solution of about 1:100. In a different embodiment, the fuel additive may comprise an aqueous solution of glyoxal and emulsifiers and/or tensids and/or antifreeze agents and the fuel additive may be used in mineral oil fuels as well as gasoline. The emulsifiers maybe esterfied aliphats and/or polyethyleneglycol and/or tensids and/or antifreeze. The antifreeze agents may be methanol, glycerol and glycol in gasoline and diesel fuel to enhance the solubility of the aqueous glyoxal solution. In another embodiment, the fuel additive may be added to a hydrocarbon fuel of interal combustion devices in vehicles and fuel fired heating plants. The fuel additive may compromise an aqueous solution of glyoxal and emulsifiers and/or tensids and/or antifreeze agents and/or an acetal of glyoxal and/or hemiacetal of glyoxal. The ratio of glyoxal solution, esterified aliphats and/or polyethlenglycol may be 2:1:1 in the fuel additive.

In the practice of the method of the invention, the addition of 500 milliliters of the gasoline-additive-emulsion to 40 liters gasoline has been found sufficient to obtain a reduction of unburned hydrocarbons of 95% in vehicles with catalytic converters at increased idle and at idle after the cars have been driven five kilometers in urban driving. Usually, carbon monoxide can no longer be identified under these conditions.

The tables that follow provide the results of a statistical survey on the results of tests with gasoline to which the above-described additive was added. As only 4 grams glyoxal were mixed into 40 liters of gasoline, it can be calculated that glyoxal shows its effectiveness as a homogeneous catalyst at the ppm-level. Furthermore, the quantity of water of 10 milliliters per 40 liter gasoline is so low that there is no danger of corrosion for the engine. Any and all components of the described additive are flammable and nontoxic so that toxic side effects can be excluded.

Figure 2:
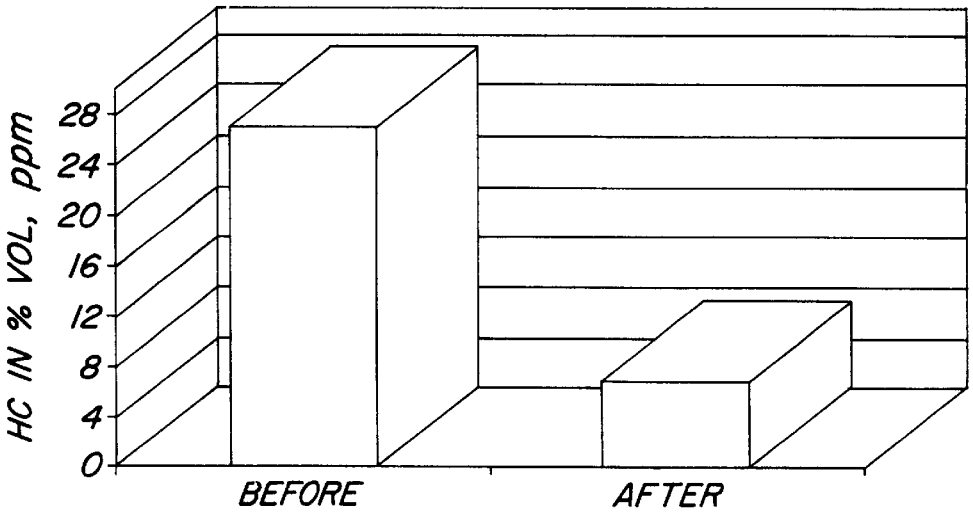
FIG. 2 is a similar graph of the reduction in emission of HC at idle.
Figure 3:
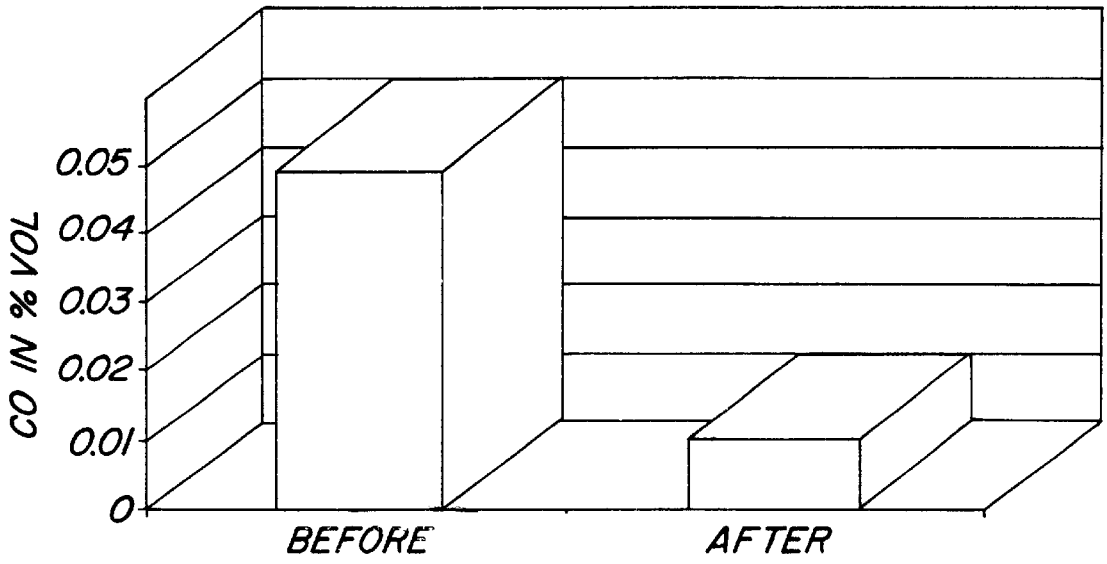
FIG. 3 is a similar graph of the reduction in emission of CO at increased idle.
Figure 4:
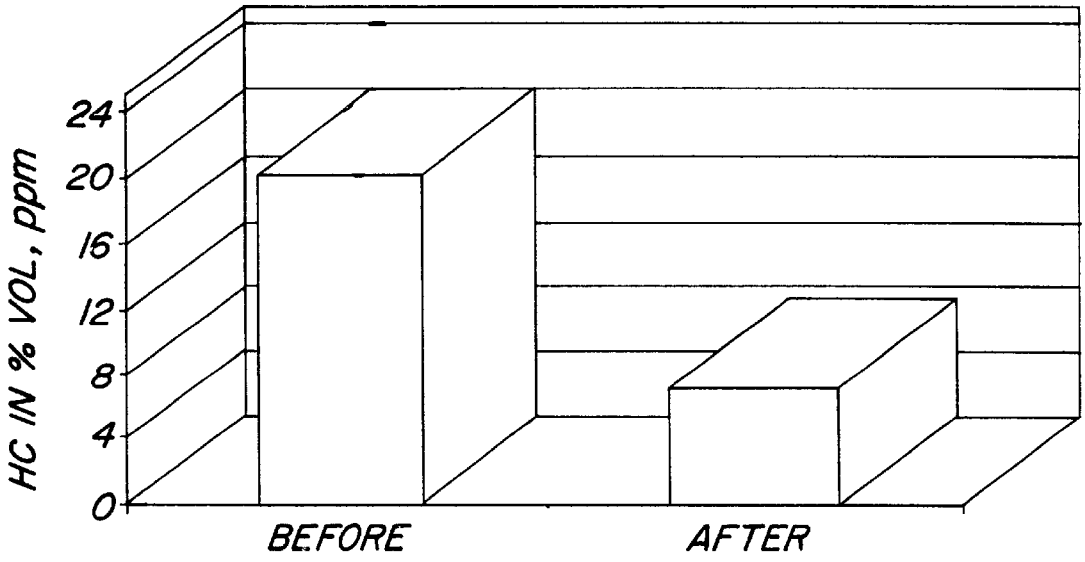
FIG. 4 is a similar graph of the reduction in emission of HC at increased idle.
Figure 5:
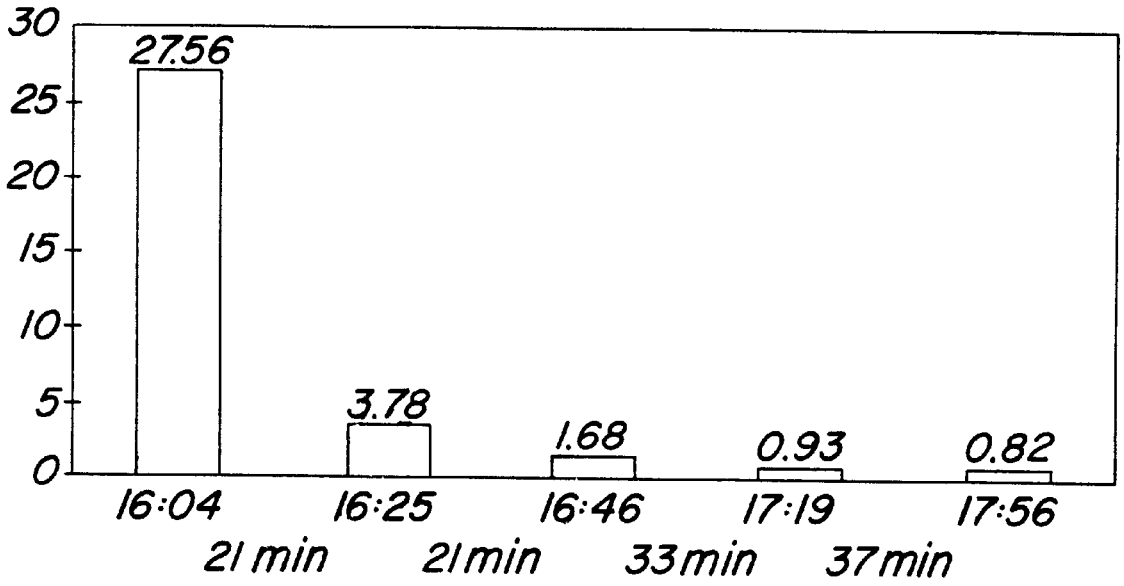
FIG. 5 is a graph of diesel emission of carbon particles with time showing the effects of the additives of the invention in reducing such emissions.

Tables I and II below as well as the graphs shown in FIGS. 1–5 provide the results of emissions tests using the glyoxal solution additive of the invention:

TABLE 1

Reduction in emission through glyoxal emulsion in gasoline (at idle) n = 22

| Date | CO before | CO after | HC before | HC after |
|---|---|---|---|---|
| 07.03.1998 | 0.01 | 0 | 34 | 5 |
| 07.03.1998 | 0 | 0 | 34 | 5 |
| 07.03.1998 | 0.01 | 0 | 79 | 2 |
| 07.03.1998 | 0 | 0 | 8 | 7 |
| 06.26.1998 | 0.01 | 0 | 6 | 3 |
| 06.26.1998 | 0 | 0 | 21 | 10 |
| 06.26.1998 | 0 | 0 | 5 | 7 |
| 06.26.1998 | 0 | 0 | 6 | 9 |
| 05.22.1998 | 0 | 0 | 5 | 3 |
| 05.22.1998 | 0 | 0 | 9 | 3 |
| 05.22.1998 | 0.02 | 0 | 54 | 10 |
| 05.22.1998 | 0.02 | 0.01 | 20 | 11 |
| 04.08.1998 | 0.1 | 0 | 111 | 6 |
| 03.25.1998 | 0 | 0 | 22 | 29 |
| 03.25.1998 | 0 | 0 | 6 | 4 |
| 03.23.1998 | 0 | 0 | 6 | 2 |
| 03.23.1998 | 0.01 | 0 | 16 | 0 |
| 03.23.1998 | 0 | 0 | 4 | 4 |
| 03.18.1998 | 0.07 | 0.09 | 34 | 13 |
| 03.05.1998 | 0.04 | 0 | 42 | 1 |
| 03.05.1998 | 0.04 | 0 | 57 | 7 |
| without date | 0.02 | 0.01 | 15 | 9 |
| average value | 0.02 | 0.01 | 27.00 | 6.82 |
| standard deviation | 0.03 | 0.02 | 27.67 | 6.06 |

TABLE 11

Reduction in emission through glyoxal emission in gasoline (at increased idle) n = 22

| Date | CO before | CO after | HC before | HC after |
|---|---|---|---|---|
| 07.03.1998 | 0.26 | 0 | 99 | 9 |
| 07.03.1998 | 0.02 | 0 | 56 | 5 |
| 07.03.1998 | 0.06 | 0 | 27 | 5 |
| 07.03.1998 | 0 | 0 | 14 | 11 |
| 06.26.1998 | 0 | 0 | 5 | 2 |
| 06.24.1998 | 0 | 0 | 10 | 12 |
| 06.24.1998 | 0 | 0.1 | 10 | 15 |
| 06.24.1998 | 0.03 | 0.01 | 8 | 9 |
| 05.22.1998 | 0 | 0 | 5 | 2 |
| 05.22.1998 | 0 | 0 | 12 | 2 |
| 05.22.1998 | 0.03 | 0 | 13 | 7 |

TABLE 11-continued

Reduction in emission through glyoxal emission in gasoline (at increased idle) n = 22

| Date | CO before | CO after | HC before | HC after |
|---|---|---|---|---|
| 05.05.1998 | 0 | 0 | 10 | 12 |
| 04.08.1998 | 0.12 | 0 | 41 | 6 |
| 03.25.1998 | 0.03 | 0.01 | 17 | 13 |
| 03.25.1998 | 0.01 | 0.02 | 8 | 5 |
| 03.23.1998 | 0 | 0 | 8 | 5 |
| 03.23.1998 | 0.1 | 0 | 27 | 0 |
| 03.23.1998 | 0 | 0 | 11 | 6 |
| 03.18.1998 | 0.29 | 0.05 | 13 | 17 |
| 03.05.1998 | 0.13 | 0 | 24 | 3 |
| 03.05.1998 | 0.01 | 0 | 16 | 8 |
| without date | 0.05 | 0.04 | 9 | 5 |
| average value | 0.05 | 0.01 | 20.14 | 7.23 |
| standard deviation | 0.08 | 0.02 | 21.49 | 4.56 |

Conditions:

All cars were BMW Type 5 (525 or 528)

measuring equipment: Digas AVL Type 465 (Graz, Austria)

Sensor AVL Type 1554

In diesel fuel, the aqueous glyoxal solution as described above is even more easily soluble than in gasoline. Here, a milky cloudy fuel mixture is obtained, the phase mixture of which is considerably more stable. Fuels to which this additive have been added produce in diesel engine vehicles at idle and at increased idle an average reduction of the particulate emission or coke deposit of 30 to 40% and of nitrogen oxides of 20%.

The miscibility in aqueous solution of glyoxal in diesel fuel can be improved by addition of phospholipids, especially Kephalin. The improved results exceed those obtainable with either the emulsifiers or solubility enhancers. The addition of only 1 ml of Kephalin (lecithinphosphatide) per 100 ml of aqueous glyoxal solution or only water results in a stable solution. This solution can be added in an amount up to 10% to diesel fuel without losing stability. The content of the phosphor in the large molecule of phospholipids is minute, being inconsequential as deposit in the burning chamber. Following this technique, a cloudy water-diesel fuel mixture is obtained. The resulting mixture can be used in the same way that normal diesel fuel is used. A second advantage of this glyoxal-diesel fuel mixture is the well known cleaning effect of low amounts of water in diesel engines, with the phospholipids again being a regenerating resource.

It is also part of the present invention that, instead of glyoxal in aqueous solution, acetals and hemiacetals of the glyoxal could be added to the fuel mixture. Ethers produced by acetalization from glyoxal with linear and branched alcohols with C 1 to C 16 carbons such as methanol, ethanol, neopentylglycol, octandiol differ in their physical appearance, e.g., the viscosity of acetals made from methanol and glyoxal and the acetals made from ethanol and glyoxal. The acetal made of neopentylglycol and glyoxal is a white powder. The 1,1,2,2 tetraeethoxyethane reacts faster than 1,1,2,2 tetramethoxyethane, whereas the later appears to last longer in terms of the reduction of emission.

The use of glyoxal in watery solution or as acetals has advantages, because:

1. A solution of pure glyoxal in fuels is never homogeneous and, as a result, the fuels get cloudy. After a short time a sedimentation from water with a high glyoxal component develops on the bottom from the reaction chamber.

2. Glyoxal is an aldehyde and oxidizes slowly and steadily in the fuel. The result is an early aging, i.e., the storing of fuel in question. However, glyoxal in watery solution cannot react directly due to the fact that water molecules deposit on the glyoxal forming "dipols" and glyoxal in its acetal form can react only after separating from the methoxy groups in the combustion chamber.

The use of glyoxal in aqueous solution thus improves the shelf life of the product. Also, it is advantageous to use the acetals of glyoxal with different linear and branched alcohols as emulsifiers to form a watery solution of glyoxal in fuel since the emulsifiers react themselves as catalyzers.

In one preferred embodiment of the present invention, instead of glyoxal in aqueous solution, acetals and hemiacetals of glyoxal are added to the fuel mixture. Acetal formation is a well known process in organic chemistry and is described, e.g., in "Organic Chemistry", Morrison and Boyd, 2nd Ed., 0969, page 633 et seq., and is used to describe compounds of the general type $RCH(OR')_2$. For example, in simplest terms, acetaldehyde reacted with methanol in the presence of HCI yields acetaldehyde diethyl acetal (Acetal). Similarly, alcohols will be added to aldehydes to produce "hemiacetals" in a reaction catalyzed by both acids and bases. A hemiacetal in the presence of an alcohol and an acid catalyst is converted to an acetal. See also, "Organic Chemistry", Holt, Rinehart and Winston, 1964, pages 308–310.

The acetals and hemiacetals used in the present invention are obtained by the acetalization of glyoxal with linear and/or branched alcohols having $C_1$–$C_{16}$ carbons such as methanol, ethanol, propanol, butanol, isopropanol, isobutanol, amylalcohol, with diols such as ethane diol, propane diol, butane diol, octane diol, neopentylglycol as well as triols such as glycerol. Furthermore mixtures of such mono-, di-, and trialcohols can be applied. Thus, the acetals and hemiacetals used in the present invention can have various alkoxy groups at the —$CH_2$—$CH_2$ unit of glyoxal. Thus different physical properties of the acetals and hemiacetals can be adjusted by the variation of the alkoxy groups.

Such acetals and hemiacetals can be prepared according to the state-of-the-art as described above. A particular way to manufacture this products is described as follow: 660 grams of molecular sieves 4 A° is placed in a column reactor. A mixture of 600 grams glyoxal trimmer hydrated and 180 grams of amberlist 15 (ion-exchange resin) is filled on top of the molecular sieve in that column. The content of the column is heated up to 80° C. Then for example methanol or ethanol is pumped through the ion exchange resin as a catalyst and through the molecular sieve (water scavenger). The ratio of methanol to glyoxal is 4 mol, in the case of ethanol 12 mol.

During 16 hours the desired compound is obtained. The purification and the separation of the desired compound from the solvent occurs by distillation. Methanol and ethanol are removed at 40° C. and 22 torr. The purification occurs at 58° C. and 20 torr.

One preferred glyoxalacetal is 1,1,2,2 tetramethoxyethane (TME) also referred to as tetramethoxyglyoxalacetale and also as 1,1 dimethoxy-2,2 dimethoxyethane. While the lowering of carbon monoxide and unburned hydrocarbons are an understandable result of an efficient homogeneous catalyst, the simultaneous lowering by 1,1,2,2 tetramethoxyethane (TME) of NOx is an unexpected result at the present time. Furthermore, the production of TME is the cheapest of all glyoxalacetals. However, the use of TME for gasoline is thought to be unique. As can be seen in the data which follows, significant lowering of NOx has been observed in different vehicles.

Four vehicles were placed upon a chassis dyno. Five gas emission testings were performed per vehicles. The fuel additive was put into the tank(s) at a ratio of one part tetramethoxyethane to 1.000 parts gasoline. The fuels were Al winter grade RFG gasoline, i.e., pump gasoline.

After introduction into the respective fuel tank, five minutes running time was allowed to measure and a second gas sample reading was taken.

The vehicles tested with odometer readings:

| Change in NOx from Baseline Readings | | |
|---|---|---|
| 1993 Mustang | 56,000 Miles | NOx Reduction 17% ppm |
| 1998 Aurora | 26,000 Miles | NOx Reduction to 0% ppm |
| 1998 Toyota | 56,000 Miles | NOx Reduction 40% ppm |
| 1981 Saab | 185,000 Miles | NOx Reduction 12.4% ppm |

These results are significant in that five minutes exposure result in only a few grams of the additive of the invention being consumed.

Later, three vehicles were treated with the fuel additive of the invention at a ration of one part tetramethoxyethane to 1.000 part gasoline. The gasoline used was "Indolene", a test base fuel and not an unknown pump grade fuel. "A ratio of glyoxal solution to emulsifier being 2:1:1 in the fuel additive may also be used. In addition to a ratio of fuel additive to fuel may be between 1: 2,000 and 1: 20,000."

With the FTP, EPA 75 test mode a baseline was formed. The vehicles were treated and conditioned.

After a short dyno run time the vehicles were refilled with test gasoline and taken out on the road. The vehicles were driven for 500 miles and were then taken back to the dyno for exhaust gas samples. The results of the test were as follows:

| 505 Seconds Dyno Time - Hot Phase | |
|---|---|
| 1999 Chevy Pick-Up | 21,000 Miles NOx Reduction 20% gram/mile |
| 1999 Ford Pick-Up | 14,000 Miles NOx Reduction 20% gram/mile |
| 1999 Chevy Corvette | 61,000 Miles NOx Reduction 10.24% gram/mile |

It appears that if a vehicle has its fuel treated and is then given a full 500 miles exposure, further changes to NOx level are possible. The above results would be from residual effects.

The additives of the invention provide a reduction in pollutant emissions and coke deposits, improving the efficiency of the combustion process and providing smoother running of the engine as well as providing a cleaning effect on the combustion chamber of the engine. The additives are formed from commercially available components and are relatively economical to manufacture.

While the invention has been shown in only two of its forms, it is not thus limited but is susceptible to various changes and modifications without departing from the spirit thereof.

What is claimed is:

1. A method for reducing pollutant emission in internal combustion engines, the method comprising the steps of:

forming a gasoline fuel additive by first combining an aqueous solution of glyoxal with an emulsifier;

thereafter adding the so formed gasoline fuel additive to a gasoline fuel being supplied to the internal combustion engine; and burning the gasoline fuel in an internal combustion engine, whereby a reduced level of pollutant emissions results.

2. The method of claim 1, wherein the emulsifier is selected from the group consisting of methanol, ethanol, glycerol, glycol and mixtures thereof, the addition of the emulsifier serving to enhance the solubility of the aqueous solution of glyoxal in the gasoline fuel being burned.

3. The method of claim 1, wherein the emulsifier for the aqueous glyoxal solution added to the gasoline fuel is selected from the group consisting of esterified aliphats and polyethyleneglycol.

4. The method of claim 1, wherein the emulsifier is a combination of esterfied aliphatics and polyethylene glycol, the ratio of glyoxal solution to emulsifier being 2 parts aqueous solution to 1 part esterfied aliphatics to 1 part polyethylene glycol in the gasoline fuel additive.

5. The method of claim 4, wherein the ratio of the gasoline fuel additive to gasoline fuel is between 1:2,000 and 1:20,000.

6. The method of claim 5, wherein the aqueous glyoxal solution and emulsifier are first homogeneously mixed and thereafter added to the gasoline fuel.

7. The method of claim 6, further comprising the steps of:

first mixing approximately 500 milliliters gasoline fuel with the glyoxal-emulsifier-mixture;

and thereafter adding methyl tertiary butylether in a ratio of 1: 50 to 1: 100 to the glyoxal-emulsifier mixture.

8. A method for reducing unburned hydrocarbons and carbon monoxide of gasoline or diesel fuels in internal combustion engines, the method comprising the steps of:

forming a gasoline or diesel fuel additive comprising mixing an aqueous solution of glyoxal and emulsifiers and/or tensides and/or antifreeze agents;

and thereafter adding the so formed product to a hydrocarbon gasoline or diesel fuel;

said gasoline or diesel fuel being supplied to the internal combustion engine; and burning the gasoline or diesel fuel in an internal combustion engine, whereby a reduced level of unburned hydrocarbons and carbon monoxide results.

9. The method of claim 8 wherein the gasoline or diesel fuel additive comprises the glyoxal solution, esterifed aliphatics and polyethylene glycol in a ratio of 2:1:1.

10. The method of claim 9, wherein the ratio of the gasoline and diesel fuel additive to gasoline or diesel fuel is between 1:500 and 1:2000.

11. The method of claim 9, further comprising the steps of:

first mixing part of the gasoline or diesel fuel with the glyoxal-emulsifier mixture; and thereafter adding methyl tertiary butylether in a ratio of 1:500 to 1:1000 to the glyoxal-emulsifier mixture.

12. The method of claim 9, wherein phospholipids are used as emulsifiers to enhance the solubility of aqueouis glyoxal solution in gasoline and diesel fuel.

13. The method of claim 9, wherein the ratio of phospholipids to aqueous glyoxal solution is about 1:100.

14. A hydrocarbon gasoline or diesel fuel of internal combustion devices in vehicles and gasoline or diesel fuel fired heating plants, the gasoline or diesel fuel comprising a gasoline or diesel fuel additive comprising an aqueous solution of glyoxal and emulsifiers and/or tensides and/or antifreeze agents.

15. The gasoline or diesel fuel according to claim 14 wherein the emulsifiers are esterfied aliphats or antifreeze agents, the antifreeze agents being selected from the group consisting of methanol, glycerol and glycol.

16. The gasoline or diesel fuel according to claim 15, comprising a mixture of glyoxal solution, esterified aliphats and glycol, wherein the ratio is essentially 2:1:1.

17. The gasoline or diesel fuel according to claim 14 wherein the antifreeze agents are selected from the group consisting of methanol, glycol and glycerol.

* * * * *